US005338186A

United States Patent [19]

Sulzhik et al.

[11] Patent Number: 5,338,186

[45] Date of Patent: Aug. 16, 1994

[54] RADIATION BURNER

[76] Inventors: Nikolai Sulzhik, Ul.Artema 70, kv.29; Pavel N. Timoshchenko, Pr.50 Let Oktiabria 9, kv339; Vitaly V. Trotsenko, Ul.Bratislavskaya 36, kv124, all of Kiev,

[21] Appl. No.: 985,854

[22] Filed: Dec. 4, 1992

[51] Int. Cl.[5] ..... F23L 9/00

[52] U.S. Cl. ..... 431/115; 431/116; 431/348

[58] Field of Search ..... 431/115, 116, 347, 348, 431/8, 9

[56] References Cited

U.S. PATENT DOCUMENTS 2,857,961 10/1958 Brown, III et al. ..... 431/116
3,817,685 6/1974 Joannes ..... 431/116
4,629,413 12/1986 Michelson et al. ..... 431/116 X
5,135,387 8/1992 Martin et al. ..... 431/116
5,154,596 10/1992 Schwartz et al. ..... 431/116 X
5,195,884 3/1993 Schwartz et al. ..... 431/116 X

*Primary Examiner*—Larry Jones
*Attorney, Agent, or Firm*—Ilya Zborovsky

[57] ABSTRACT

A radiation gas burner has a gas nozzle for supplying gas, an injector for injecting gas from the gas nozzle, an outlet pipe to which gas is supplied by the injector, a reflector cooperating with the outlet pipe, and a burner stone, the burner stone having at least two layers including a front layer composed of a refractory material with additives increasing the degree of blackness of the refractory material.

8 Claims, 2 Drawing Sheets

RADIATION BURNER

BACKGROUND OF THE INVENTION

The present invention relates to radiation burners. Such burners are utilized in chemical, oil processing and oil chemical industries, in metallurgy and other areas where it is necessary to provide an indirect radiation heat exchange.

One of such radiation burners is disclosed in Soviet Inventors' Certificate No. 954,079. The burner includes an injector with a gas nozzle, a regulating disc, a cylindrical outlet member provided with a reflector and accommodated in a recess of a burner stone fixed in a casing which is arranged with a gap relative to the rear wall of the stone. The above described burner, similarly to other burner devices, has the disadvantage in its low degree of blackness of the refractory burner stone, which at the temperature of 1,520°-1,550° K. is approximately 0.3-0.4. This degree of blackness determines a certain density of the heat flow which cannot be increased without the artificial increase of the degree of blackness of the refractory material. Another disadvantage of this burner is that it is not possible to suppress the formation of nitrogen oxides which are quite substantial in the waste products of combustion at temperature of 1520°-1,550° K. The ejection of the fuel gas from the burner nozzle with a high speed produces high noise which is another disadvantage of the known burner.

Other radiation burners of this type are disclosed for example in U.S. Pat. No. 3,664,424 and French Patent 2,195,328. The radiation burner disclosed in these references includes an injector with a gas nozzle, the burner head and a movable slider. The burner is mounted in a recess formed in a ceramic block which forms a part of the furnace wall. In accordance with another embodiment, the section of the burner which extends outside of the outer surface of the furnace wall is enclosed in a casing provided with a mounting plate which is fixed with a gap to a steel outer plate of the furnace. The casing is provided with a noise-absorbing lining which is held by a perforated sheet. The burner head has a plurality of peripheral longitudinal openings for passing of a prepared gas-air mixture. In order to provide the high quality combustion of the fuel gas of changing content, the burner is provided with air suction of a secondary air. This burner similarly to many other flow burners has the disadvantage that its construction does not permit substantial increase of its output without the increase of its size. For this reason if the minimal output is to be increased three times, it is necessary to replace the injector and the gas head. The second disadvantage of this burner is that it does not permit a high quality flame-free combustion of the fuel gas, since the burner head is located at a substantially great distance from the surface of the ceramic block, and the gas-air mixture which ejects through the longitudinal openings in the burner head in a substantially thick layer does not completely burn at the surface of the furnace wall. As a rule, the final combustion takes place inside the furnace, which leads to an incomplete combustion and excessive consumption of fuel. Finally, a further disadvantage of the burner is that the suction of the secondary air for increasing the combustion degree of fuel gas is obtained only due to the modification in the furnace combustion chamber. This makes its regulation very difficult. The insufficient quantity of air leads to a chemically incomplete combustion and environmental loading with products of incomplete combustion. If the optimal demand for air is exceeded, this leads to the increase in losses with ejected combustion products and ejection of toxic gases.

SUMMARY OF THE INVENTION

Accordingly, it is an object of the present invention to provide a radiation burner which avoids the disadvantages of the prior art.

In keeping with these objects and with others which will become apparent hereinafter, one feature of the present invention resides, briefly stated, in a burner in which a burner stone has at least two layers formed so that one layer which is a main part of the stone is composed of a refractory material while the front layer at which the combustion of fuel takes is composed of the same refractory material with addition of metals or metal oxides for increasing the degree of blackness of the refractory approximately 2-2.5 times.

In accordance with another feature of the present invention, the burner stone has passages and a chamber for recirculation of some quantity of combustion products to the bottom of the flame, in order to reduce the combustion temperature and reduce the contents of nitrogen oxides in the combustion products.

The burner in accordance with a further feature of the present invention, is provided with a device for regulating a consumption of the primary air, which at the same time operates as a noise absorber, and for this purpose it is made as a noise absorbing casing.

The burner is further provided with an outer cylindrical bushing, which, in combination with a ring on the outside nozzle, prevents tilting of the burner relative to its axis. This insures a stable annular gap in order to obtain a uniform supply of the secondary air.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
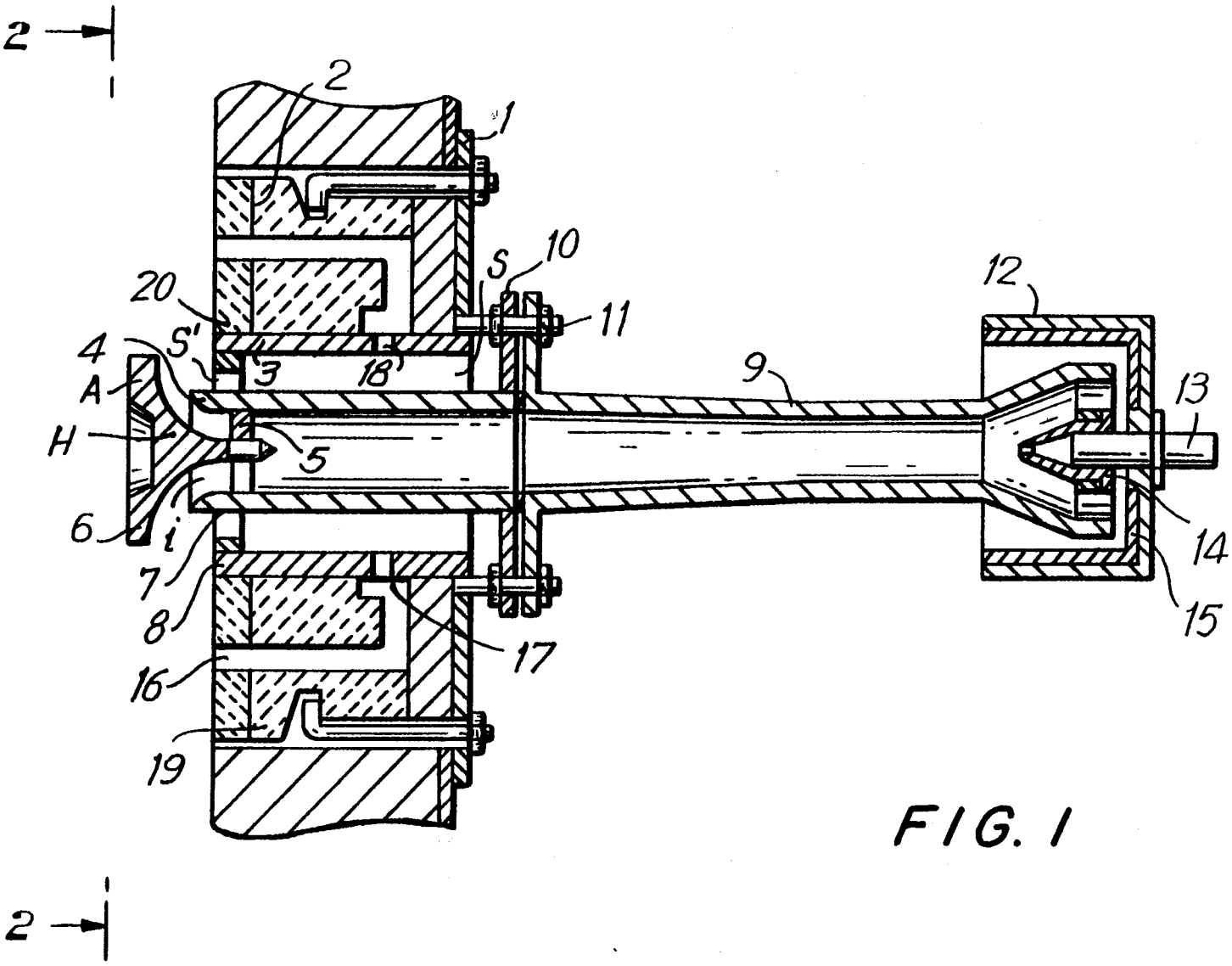
FIG. 1 is a sectioned side view of a radiation burner in accordance with the present invention.
Figure 2:
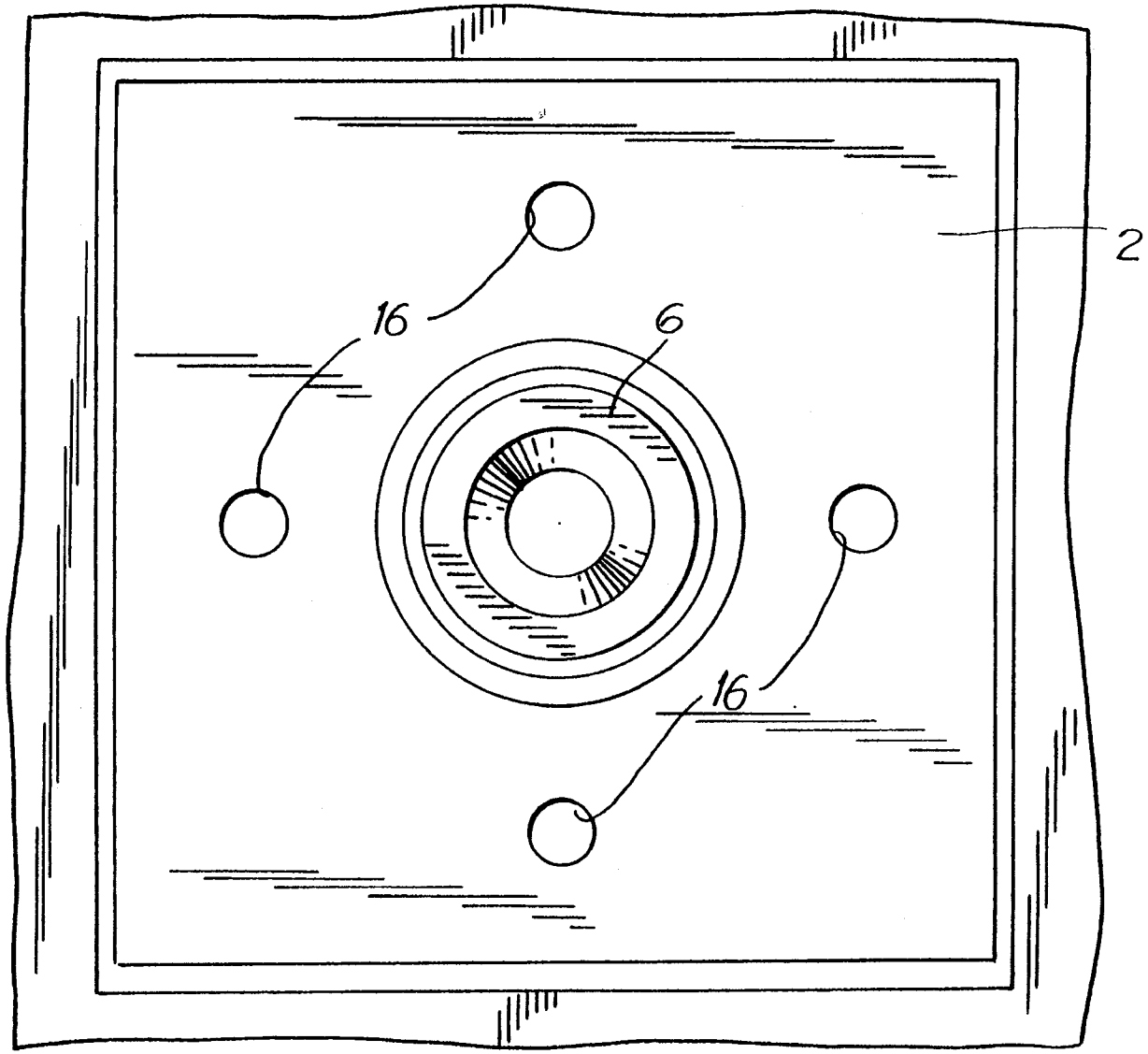
FIG. 2 is a view showing a section taken along the line II—II in FIG. 1.

A radiation burner in accordance with the present invention has a mounting plate which is identified with reference numeral 1 and a two-layer burner stone 2 which includes a layer 19 composed of a regular refractory material and a layer 20 composed of a regular refractory material with some additives, particularly metal oxides such that they increase the blackness of the stone front radiating surface. The burner stone 2 has passages 16 and a chamber 17. It is mounted on a mounting plate 1 by bolts 22. A cylindrical bushing 3 is arranged in an opening of the burner stone 2. The cylindrical bushing 3 has one end connected with the mounting plate 1.

An outlet pipe 4 is coaxially arranged inside the cylindrical bushing 3 so as to form an annular gap S'.

A reflector 6 is mounted on the end of the outlet pipe 4 coaxially therewith by means of radial plates 5. The reflector 6 has a cylindrical portion A formed as a disc, and also a portion H formed as a body of revolution with a concave generatrix substantially corresponding to a truncated cone with a greater base at the end of the portion H. The portion H of the reflector is located inside the outlet pipe 4 and together with it forms an annular outlet nozzle i through which gas-air mixture can exit. A ring 8 is arranged at the outer side of the outlet pipe 4 in its front part by means of pins 7 so as to form a gap S' for passage of a secondary air and combustion products.

The burner further has an injector 9 which is mounted to the outlet pipe 4 by a flange 10 and pins 11. The pins 11 are fixed in the mounting plate 1. The burner also has a regulating device 12 formed as a noise absorbing casing which is mounted on the pipe 13 so that it can move along its axis to change the gap between the device 12 and the front surface of the injector 9. Thereby the regulation of consumption of the supplied primary air is obtained. The pipe 13 is also provided with a nozzle 14 for supplying a fuel gas. The regulating device 12 has a noise absorbing insulation 15 reducing the noise during operation of the burner.

The above described radiation burner operates in the following manner. A fuel gas is supplied into the burner through the pipe 13, exits from the gas nozzle 14 as a compressed jet and entrains a primary air which is mixed with the gas so as to form a unitary gas-air jet. This jet moves through the injector 9, outlet pipe 4 to the reflector 6, it is guided by the portion H of the reflector, and exits from the portion H substantially parallel to the working surface of the burner stone 2. The jet of the mixture of the fuel gas and primary air has a certain speed, it passes through the annular outlet nozzle I and sucks in the secondary air which is supplied through the annular gaps S and S'. The secondary air, in turn, sucks in the combustion products which are supplied through the passages 16 and the chamber 17 provided in the burner stone 2, and then through the openings 18 provided in the cylindrical bushing 3. The thusly produced recirculation of some quantity of combustion products into the combustion zone reduces the combustion temperature and results in significant reduction of the nitrogen oxides. The mixture which is formed from the fuel gas with the primary air, the secondary air, and partially dissolved with the combustion products, is distributed over the working surface of the burner stone 2 and is burnt there in a thin layer. Thereby the working surface of the burner stone 2 is heated to high temperature and radiates the heat energy into the combustion area of the furnace.

The increase of the degree of blackness of the radiation part of the burner stone significantly increases the density of the heat stream, intensifies the heat exchange in the combustion area, and as a result reduces the consumption of fuel gas.

The outer cylindrical bushing 3, in addition to reliably fixing the burner in this horizontal position, also together with the mounting plate 1 and the pins 22 provide such a mounting of the burner stone 2, that it is no longer necessary to have a big casing with a double bottom as in the first mentioned reference. Therefore, the metal consumption of the burner is significantly reduced. Moreover, the mounting and demounting steps are substantially simplified. For example, in order to exchange the reflector 6 which has a diameter not exceeding the diameter of the ring 8, it suffices to screw the nuts on the pins 11 and remove the inner part of the burner from the cylindrical bushing 3. Such steps can be performed even when the furnace is in operation.

Since the burner has a self-regulating suction of the secondary air, it provides efficient combustion of gases of both permanent and changing content. Thus, when the density of the fuel gas increases, consumption is also increased; therefore, the necessary quantity of injecting primary air must increase as well. However, this does not happen since the speed of ejection of gas from the nozzle remains constant. The insufficient quantity of the primary air is compensated by the secondary air, since when the consumption of gas increases, the speed of ejection of the gas-air mixture from the annular nozzle is increased and therefore the greater quantity of secondary air is sucked in. As a result, the incomplete fuel combustion is prevented.

When the density of the fuel gas reduces, its consumption is also reduced and therefore the speed of ejection of the gas air mixture from the annular nozzle is reduced. Despite this, the flame does not jump into the burner due to screen which is formed by the secondary air and the recirculated combustion products.

The possibility of self-regulation of the ratio of the primary and secondary air provides the possibility of increasing of the coefficient of working regulation of the burner output. This ratio is a ratio of the nominal output to the minimal output. In the burner in accordance with the present invention it is equal to substantially 8, while in the known injection burners it is equal to substantially 3.

It will be understood that each of the elements described above, or two or more together, may also find a useful application in other types of constructions differing from the types described above.

While the invention has been illustrated and described as embodied in a radiation burner, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A radiation burner, comprising a burner stone having an axis and a front surface over which a flame is distributed and which is heated by the flame so as to radiate heat, said burner stone being ring-shaped;

an outlet pipe arranged radially inwardly of said burner stone and forming a first annular space between said burner stone and said outlet pipe and a second cylindrical space inside said outlet pipe, each of said spaces having an axially rear inlet and an axially front outlet;

means for supplying a fuel-gas mixture into said rear inlet of said cylindrical space so that said mixture exits said front outlet of said cylindrical space and is ignited to produce said flame and at the same time secondary air is sucked through said rear inlet of said annular space so as to pass through the latter and exit through said front outlet of said annular space toward said flame; and passage means extending from said front surface axially back into said burner stone and through said burner stone and opening into said annular space at a location between said real inlet and said front outlet of said annular space so that combustion products are sucked from an area of said front surface by said secondary air into said annular space and exit said annular space through said front outlet of said annular space together with said secondary air.

2. A radiation burner as defined in claim 1, wherein said burner stone has a rear surface; and further comprising a mounting flange extending over said rear surface of said burner stone and connected with the latter; and a cylindrical bushing extending inwardly of said burner stone and radially outwardly limiting said annular space, said bushing supporting said burner stone and said mounting flange and having a central through opening which communicates said passage means with said annular space.

3. A radiation burner, comprising a burner stone having an axis and a front surface extending transversely to said axis so that a flame is distributed over said front surface and said front surface is heated by the flame so as to radiate heat; and means for supplying a fuel-gas mixture to said front surface axially through an interior of said burner stone so that said mixture can be ignited and produce said flame over said surface, said burner stone having an axially rear portion composed of a refractory material, and an axially front portion which forms said front surface and is composed of a refractory material with a blackness increased with respect to said refractory material of said rear portion.

4. A radiation burner as defined in claim 3, wherein said refractory material of said front portion includes metal oxides which provide the increased degree of blackness.

5. A radiation burner comprising a burner stone having a front surface over which a flame is distributed and which is heated by the flame so as to radiate heat;

means for supplying a fuel-gas mixture to said front surface so that said mixture an be ignited and produce said flame over said surface;

means for supplying a secondary air to said front surface and including a secondary air supplying passage; and means for withdrawing end products of combustion of said fuel-gas mixture from a zone near said front surface and introducing the end products of combustion into said secondary air supplying passage, so that the end products of combustion are returned back into said flame being carried by said secondary air through said secondary air supplying passage, said fuel-gas mixture supplying means including a central pipe which opens at sad front surface, said secondary air supplying means including a coaxial bushing which surrounds said central pipe and forms said secondary air supplying passage therebetween, said withdrawing and introducing means including an end products passage extending from said front surface through said burner stone and into said secondary air supplying passage.

6. A radiation burner as defined in claim 5, wherein said fuel-gas mixture supplying means includes means for regulating a quantity of gas supplied to the fuel, said regulating means being formed as a noise-absorbing casing.

7. A radiation burner as defined in claim 5, wherein said end products passage has a first passage part extending from said front surface, and a second passage part formed as a wider chamber and extending from said first passage into said secondary air supplying passage.

8. A radiation burner as defined in claim 5; and further comprising a reflector mounted on said central pipe forwardly of said front surface.

* * * * *